US008102323B2

(12) United States Patent
Chen

(10) Patent No.: US 8,102,323 B2
(45) **Date of Patent: *Jan. 24, 2012**

(54) HYBRID DUAL DIPOLE SINGLE SLOT ANTENNA FOR MIMO COMMUNICATION SYSTEMS

(75) Inventor: Mexx Chen, Taipei (TW)

(73) Assignee: Lantiq Deutschland GmbH, Neubiberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/855,689

(22) Filed: Aug. 12, 2010

(65) Prior Publication Data

US 2010/0302115 A1 Dec. 2, 2010

Related U.S. Application Data

(63) Continuation of application No. 11/969,243, filed on Jan. 4, 2008, now Pat. No. 7,786,942.

(51) Int. Cl.
*H01Q 1/00* (2006.01)

(52) U.S. Cl. ..... 343/727

(58) Field of Classification Search ..... 343/725–727, 343/767

See application file for complete search history.

(56) References Cited

U.S. PATENT DOCUMENTS

| | | | | |
|---|---|---|---|---|
| 4,176,356 | A | 11/1979 | Foster et al. | |
| 4,814,777 | A | 3/1989 | Monser | |
| 7,358,912 | B1 | 4/2008 | Kish et al. | |
| 2004/0027304 | A1 | 2/2004 | Chiang et al. | |
| 2004/0070543 | A1 | 4/2004 | Masaki | |
| 2005/0042988 | A1 | 2/2005 | Hoek et al. | |
| 2006/0239369 | A1 * | 10/2006 | Lee | 375/260 |
| 2007/0135167 | A1 | 6/2007 | Liu | |
| 2009/0096699 | A1 | 4/2009 | Chiu et al. | |

OTHER PUBLICATIONS

Non-Final Office Action, U.S. Appl. No. 11/969,243, Sep. 15, 2005.

* cited by examiner

*Primary Examiner* — Huedung Mancuso
(74) *Attorney, Agent, or Firm* — SpryIP, LLC

(57) ABSTRACT

An antenna arrangement implemented within a printed circuit board (PCB) having three metal coplanar layers, for use in multiple input multiple output (MIMO) communication systems. The antenna arrangement comprises a first dipole antenna and second dipole antenna, substantially symmetrical to the first dipole antenna a slot antenna positioned substantially between the first and the second dipole antennas. The antenna arrangement is implemented in three coplanar metal layers. The antennas are used for MIMO communication systems, specifically complying with IEEE 802.11n and are shaped such that their combined radiation pattern exhibits a substantially omni-directional radiation pattern.

20 Claims, 5 Drawing Sheets

HYBRID DUAL DIPOLE SINGLE SLOT ANTENNA FOR MIMO COMMUNICATION SYSTEMS

RELATED APPLICATIONS

This Application is a Continuation Application of co-pending patent application Ser. No. 11/969,243, which was filed on Jan. 4, 2008. The entire contents of the co-pending application are hereby incorporated herein by reference.

BACKGROUND

Printed antennas are antennas in which the antenna's elements are implemented as metal layers within a printed circuit board. Printed antennas are extensively used today in wireless communication systems. The PCB implementation of such antennas reduces both space and costs and further increases the efficiency of the communication system as a whole.

Multiple input multiple Output (MIMO) is the use of multiple antennas at both the transmitter and receiver to improve communication performance. MIMO technology offers significant increases in data throughput and link range without additional bandwidth or transmit power. It achieves this by higher spectral efficiency and link reliability or diversity.

SUMMARY

The detailed description is described with reference to the accompanying figures. In the figures, the left-most digit(s) of a reference number identifies the figure in which the reference number first appears. The use of the same reference number in different instances in the description and the figures may indicate similar or identical items.

Accordingly, it is a principal object of the present invention to supply a printed antenna that combines two dipole antennas and a single slot antenna positioned between the dipole antennas. Specifically, all of the antenna's elements are incorporated in a PCB and used in MIMO communication systems.

In embodiments the antenna arrangement may be implemented within a printed circuit board (PCB) having three metal co planar layers, for use in multiple input multiple output (MIMO) communication systems. The antenna arrangement comprises a first dipole antenna and second dipole antenna, substantially symmetrical to the first dipole antenna a slot antenna positioned substantially between the first and the second dipole antennas. The antennas are used for MIMO communication and are shaped such that their combined radiation pattern exhibits a substantially omni-directional radiation pattern.

Thus, a complementary radiation pattern is achieved. The radiation pattern of the slot antenna complements the dead zones of the dipole antennas.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different instances in the description and the figures may indicate similar or identical items.

Figure 1:
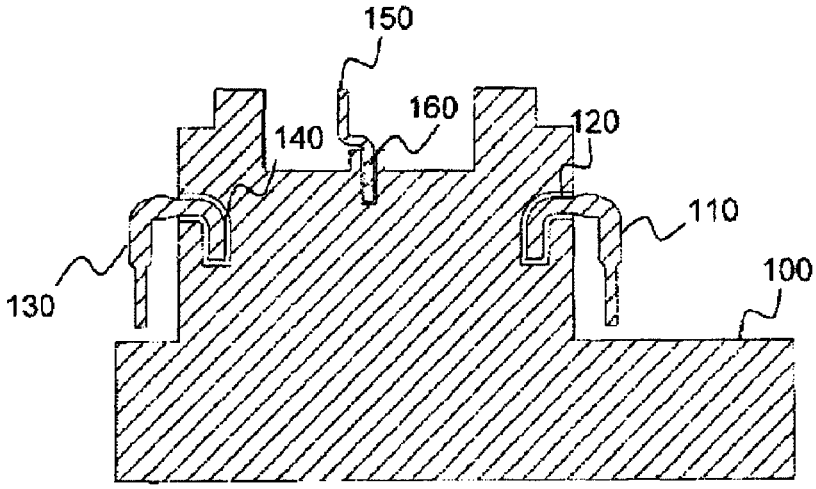
FIG. 1-FIG. 3 show exemplary layers of the antenna arrangement components according to some embodiments of the disclosure.

The drawings together with the description make apparent to those skilled in the art how the invention may be embodied in practice.

Further, where considered appropriate, reference numerals may be repeated among the figures to indicate corresponding or analogous elements.

DETAILED DESCRIPTION

In the following detailed description, numerous specific details are set forth in order to provide a thorough understanding of the disclosure. However, it will be understood by those skilled in the art that the teachings of the present disclosure may be practiced without these specific details. In other instances, well-known methods, procedures, components and circuits have not been described in detail so as not to obscure the teachings of the present disclosure.

According to some embodiments, there is provided herein an antenna arrangement implemented within a printed circuit board (PCB) for use in multiple input multiple output (MIMO) communication systems. The antenna arrangement comprises a first dipole antenna, a second dipole antenna, substantially symmetrical to the first dipole antenna and a slot antenna positioned substantially between the first and the second dipole antennas.

The antennas are used for MIMO communication systems and are shaped and positioned such that their combined radiation pattern exhibits a substantially omni-directional radiation pattern.

Figure 2:
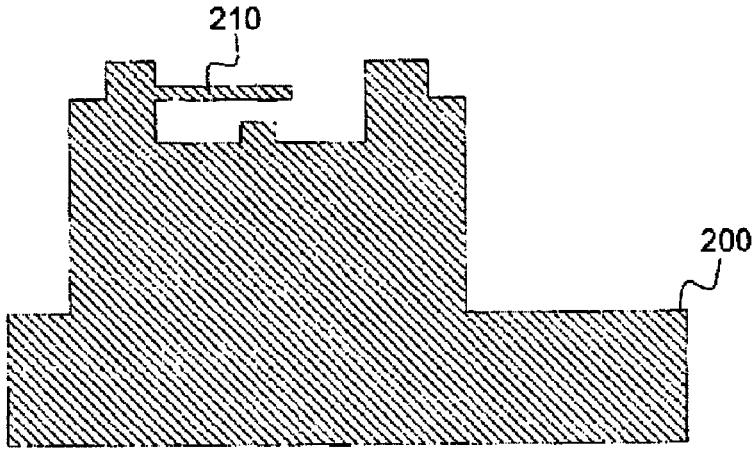
Figure 3:
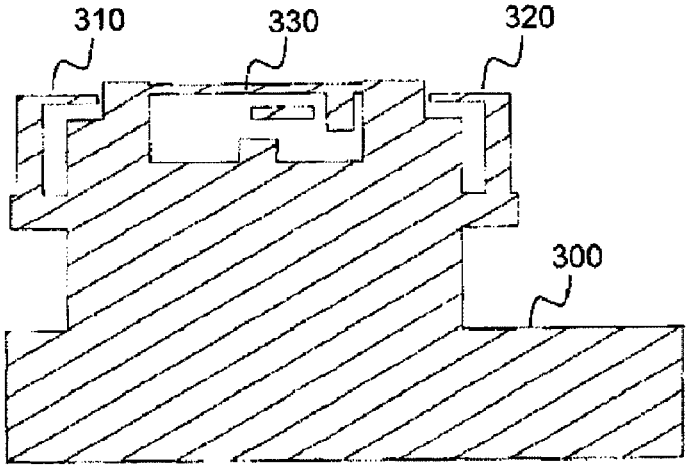

FIGS. 1-3 show the metal layers that may be used to implement the structure of the antenna, according to some embodiments of the invention, the antenna arrangement comprises an upper 100, middle 200 and lower 300 co-planner metal layer having an insulating layer (not shown) between each two adjacent layers and wherein the lower layer is grounded.

Figure 4:
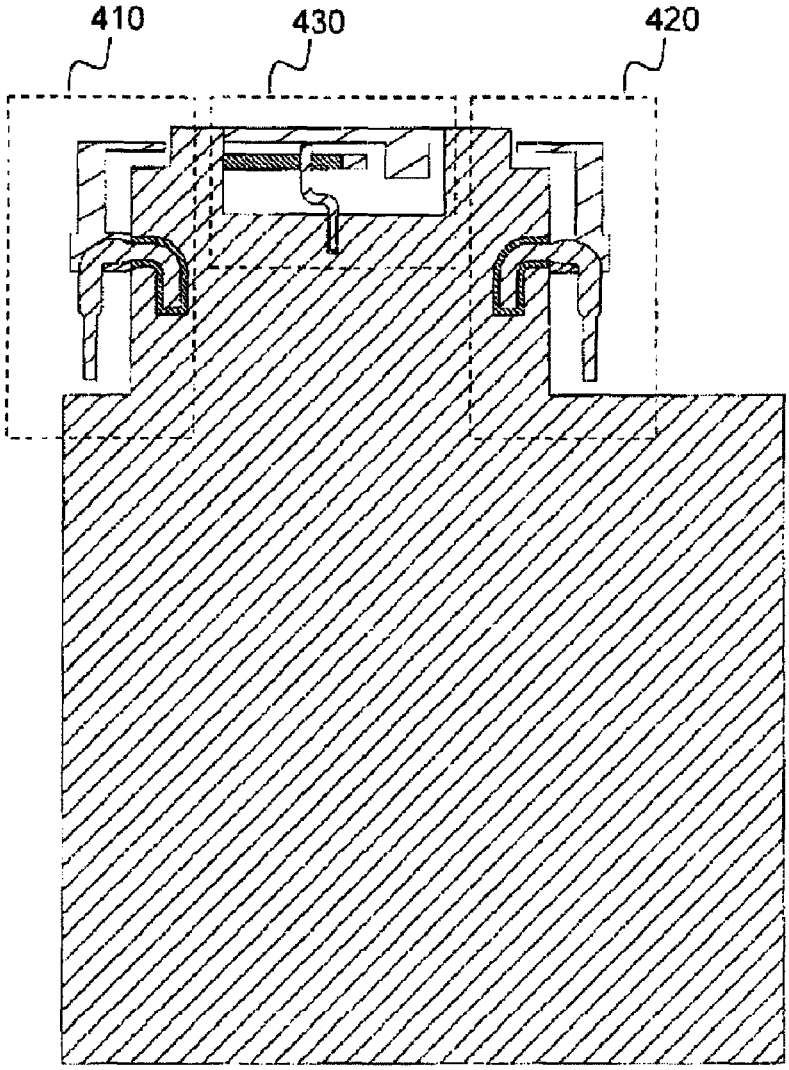
FIG. 4 is an exemplary implementation of the combination of the layers of FIG. 1-FIG. 3 implementing the antenna arrangement according to some embodiments of the disclosure.

FIG. 4 shows the combined layers into one antenna arrangement. According to some embodiments of the invention, each dipole antenna 410, 420 comprises a radio frequency (RF) signal line member 110, 130 protruding sideways from the upper layer 100, extending to one direction and coupled to the upper layer via a 50 Ohms transmission line 120, 140; a ground member 310, 320 protruding sideways from the lower layer 300, extending to an opposite direction from the RF signal member and substantially parallel to the RF signal line member.

Figure 5:
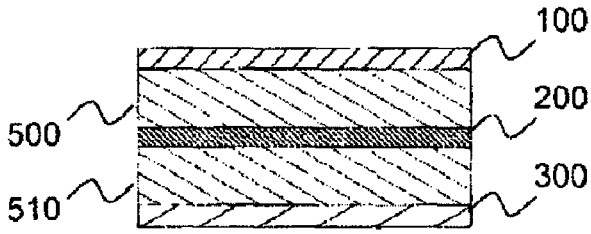
FIG. 5 is a cross section showing the order of the layers of the antenna arrangement according to some embodiments of the disclosure.

FIG. 5 shows a cross section of the PCB. Accordingly, coplanar layers 100, 200 and 300 are positioned with insulating material between them such as substrate 500, 510.

According to some embodiments of the invention, each 50 Ohms transmission line 120, 140 complies with the coplanar waveguides requirements.

According to some embodiments of the invention, the RF signal members 110, 130 and the ground members 310, 320 are substantially "L" shaped and quarter wavelength long.

According to some embodiments of the invention, the RF signal members 110, 130 have a tipped end.

According to some embodiments of the invention the slot antenna 430 comprises a slot RF signal line member 150 protruding from the upper layer, coupled to the upper layer via a 50 ohms transmission line 160 and substantially perpendicular to a first slot member extending from the middle layer; substantially parallel and non-overlapping to a second slot member extending from the ground layer to the opposite direction of the first slot.

According to some embodiments of the invention the slot members 210, 320 are quarter wavelength long and wherein the RF slot signal line member 150 is "L" shaped and one eighth wavelength long.

According to some embodiments of the invention the 50 Ohms transmission line complies with the coplanar waveguides requirements.

According to some embodiments of the invention, the antenna arrangement is configured to operate within the 2-6 GHz frequency range.

According to some embodiments of the invention, the components of the antenna arrangement are shaped for optimal omni-directional radiation pattern in operation frequency of approximately 2.4 GHz.

Figure 6:
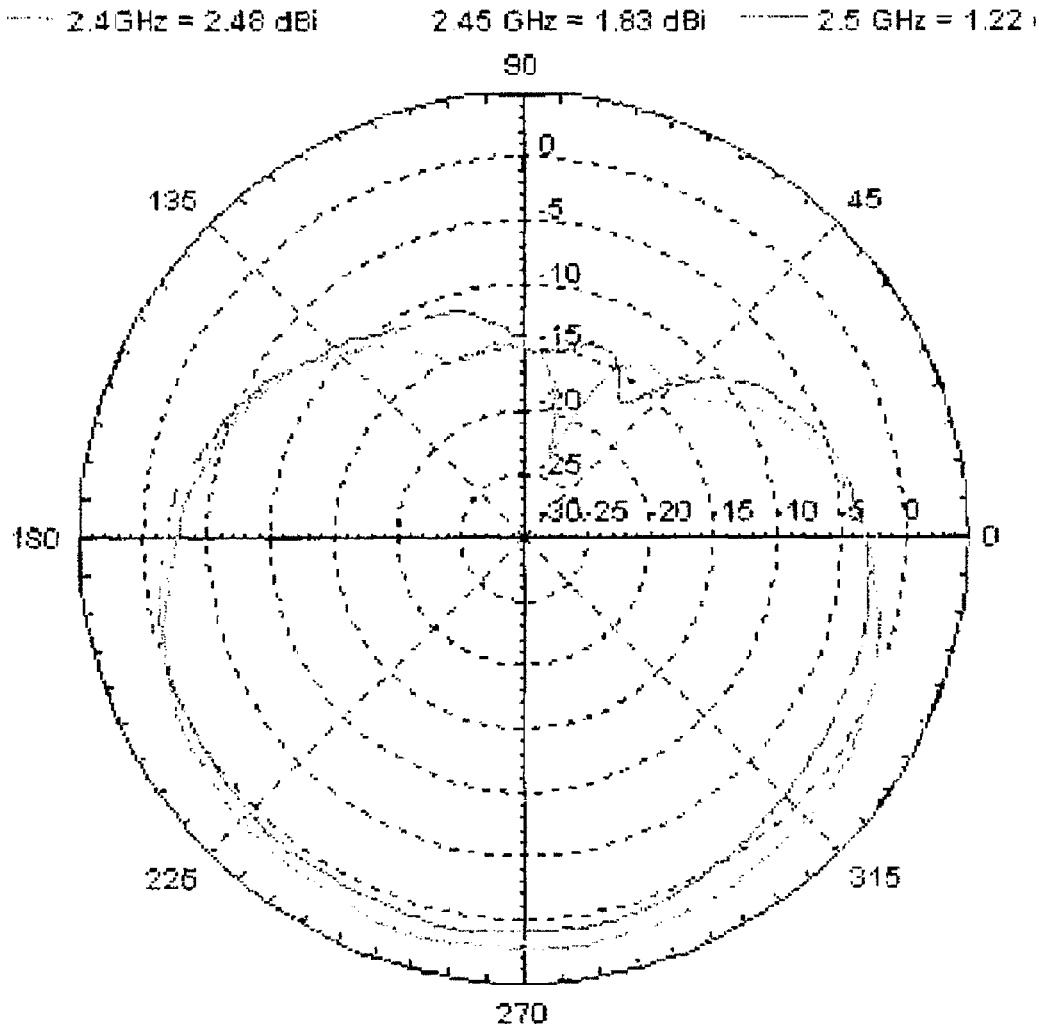
FIGS. 6-8 show radiation pattern simulation diagrams of the first dipole antenna, the second dipole antenna and the slot antenna respectively.
Figure 7:
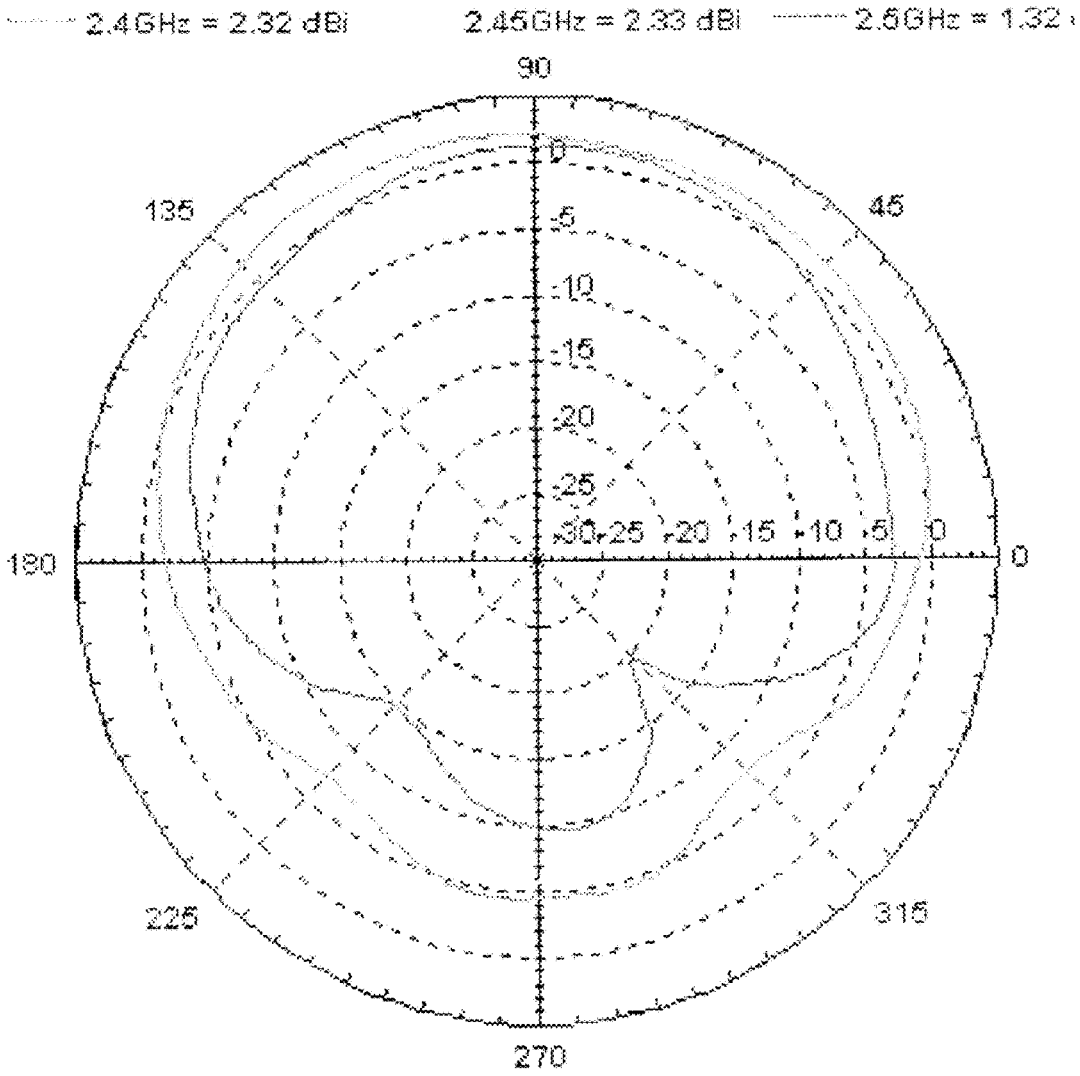
Figure 8:
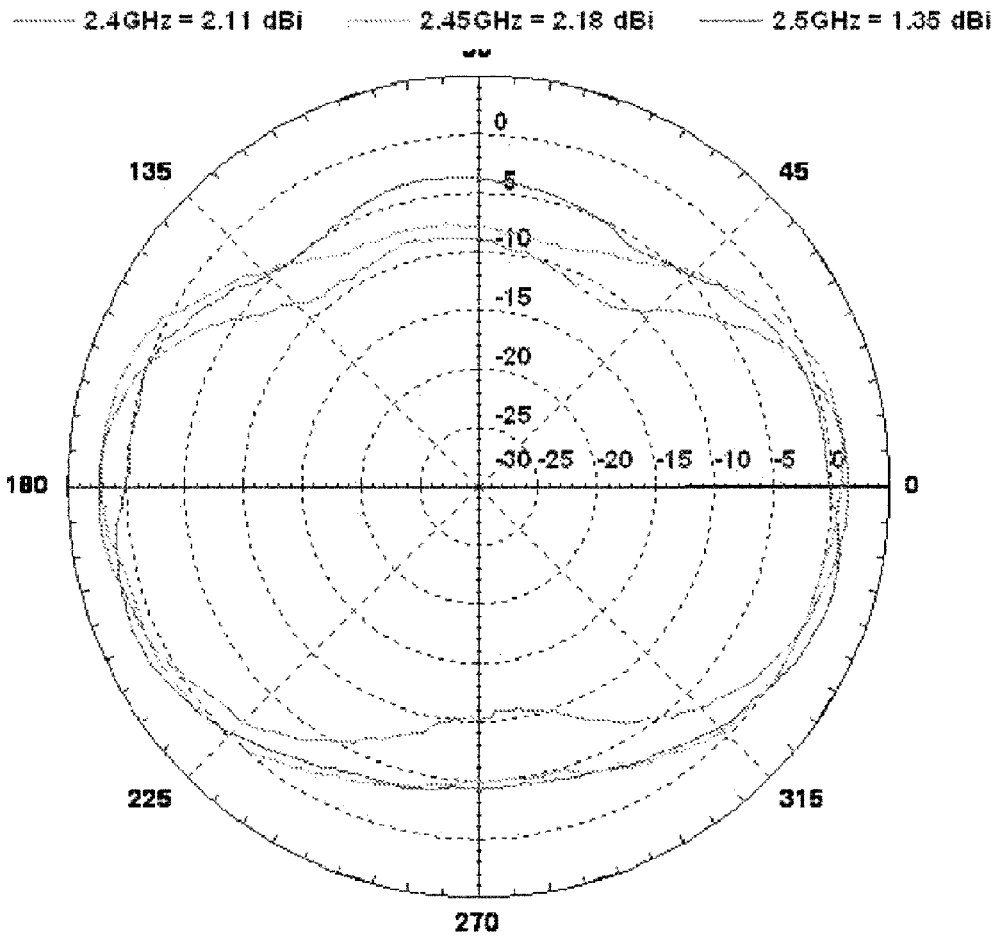

FIGS. 6-8 show the radiation pattern of each antenna separately: the first dipole, the second dipole and the slot antenna. The patterns reveal that each antenna operating alone has a "dead zone". It is further shown that combining all three diagrams achieves a substantially omni-directional radiation pattern.

According to some embodiments of the invention, the antenna arrangement is configured to operate in conjunction with a MIMO transceiver.

According to some embodiments of the invention the MIMO transceiver is configured for use in a wireless local area network (WLAN) communication system.

According to some embodiments of the invention the antenna arrangement is configured to operate within a WLAN communication system that complies with the IEEE 802.11 family standards, specifically the high throughput standard IEEE 802.11n.

According to some embodiments of the invention, the antenna arrangement exhibits a voltage standing wave ratio smaller than 1:2.

According to some embodiments of the invention the first and the second dipole antenna each comprise a substantially "U" shaped radio frequency (RF) signal line member protruding sideways from the upper layer, coupled to the upper layer via a 50 Ohms transmission line; a ground member comprising two substantially "L" shaped members extending to opposite directions, protruding sideways from the lower layer, defining a slot between themselves and substantially parallel to the RF signal line member. This configuration enables the antenna arrangement to operate in approximately 5 GHz.

According to some embodiments of the invention, the antenna arrangement is further configured to operate in a dual band mode of approximately 2.4 GHz and 5 GHz. This is done by utilizing the 5 GHz configuration and further adding "L" shape members, thinner than the ground members and perpendicular to the ground members. Moreover, another requirement in the design of the dual band mode is that the dipole antennas are asymmetric.

It is to be understood that an embodiment is an example or implementation of the invention. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions.

It is understood that the phraseology and terminology employed herein is not to be construed as limiting and is for descriptive purpose only.

The principles and uses of the teachings of the present invention may be better understood with reference to the accompanying description, figures, and examples.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, integers or groups thereof and that the terms are not to be construed as specifying components, features, steps or integers.

If the specification or claims refer to "an additional" element, that does not preclude there being mole than one of the additional element.

It is to be understood that where the claims or specification refer to "a" or "an" element, such reference is not to be construed as there being only one of that element.

It is to be understood that where the specification states that a component, feature, structure, or characteristic "may", "might", "can" or "could" be included, that particular component, feature, structure, or characteristic is not required to be included.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "upper", "middle", "lower", "bottom", "below", "top" and "above" as used herein do not necessarily indicate that a "bottom" component is below a "top" component, or that a component that is "below" is indeed "below" another component or that a component that is "above" is indeed "above" another component. As such, directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

The invention claimed is:

1. An antenna arrangement implemented within a printed circuit board (PCB) for use in multiple input multiple output (MIMO) communication systems, said antenna arrangement comprising:

a first antenna;

a second antenna; and a third antenna positioned substantially between the first and the second antennas;

wherein the antennas are used for MIMO communication and are shaped such that their combined radiation pattern exhibits a substantially omni-directional radiation pattern, and the antenna arrangement comprises a plurality of metal layers, the plurality of metal layers including first, second and third metal layers arranged in aligned parallel orientation.

2. The antenna arrangement of claim 1, wherein an insulating layer is between each two adjacent layers and wherein one of the first, second and third metal layers is grounded.

3. The antenna arrangement of claim 2, wherein the first and the second antenna each comprise:

a radio frequency (RF) signal line member protruding sideways from a layer, extending to one direction and coupled to the layer via a 50 Ohms transmission line;

a ground member protruding sideways from another layer, extending to an opposite direction from the RF signal member and substantially parallel to the RF signal line member.

4. The antenna arrangement of claim 3, wherein the 50 Ohms transmission line complies with the coplanar waveguides requirements.

5. The antenna arrangement of claim 3, wherein the RF signal members and the ground are substantially "L" shaped and quarter wavelength long.

6. The antenna arrangement of claim 4, wherein the RF signal members have a tipped end.

7. The antenna arrangement of claim 2, wherein the third antenna comprises:

a slot RF signal line member protruding from a layer, coupled to the layer via a 50 ohms transmission line, and substantially perpendicular to a first slot member extending from another layer, and substantially parallel and non-overlapping to a second slot member extending from the grounded layer to the opposite direction of the first slot.

8. The antenna arrangement of claim 7, wherein the slot members are quarter wavelength long and wherein the RF slot signal line member is "L" shaped and one eighth wavelength long.

9. The antenna arrangement of claim 7, wherein the 50 Ohms transmission line complies with the coplanar waveguides requirements.

10. The antenna arrangement of claim 1, configured to operate within the 2-6 GHz frequency range.

11. The antenna arrangement of claim 1, shaped for omni-directional radiation pattern in operation frequency of approximately 2.4 GHz.

12. The antenna arrangement of claim 1, configured to operate in conjunction with a MIMO transceiver.

13. The antenna arrangement of claim 12, wherein said MIMO transceiver is to be used in a wireless local area network (WLAN) communication system.

14. The antenna arrangement of claim 13, wherein said WLAN communication system complies with the IEEE 802.11 family standards.

15. The antenna arrangement of claim 13, exhibiting a voltage standing wave ratio smaller than 2.

16. The antenna arrangement of claim 2, wherein the first and the second antenna each comprise:

a substantially "U" shaped radio frequency (RF) signal line member protruding sideways from a layer, coupled to the layer via a 50 Ohms transmission line; a ground member comprising two substantially "L" shaped members extending to opposite directions defining a slot between themselves and substantially parallel to the RF signal line member;

wherein said arrangement is configured to operate in approximately 5 GHz.

17. The antenna arrangement of claim 16, further configured to operate in a dual band mode of approximately 2.4 GHz and 5 GHz.

18. An antenna arrangement implemented within a printed circuit board (PCB) for use in at least multiple input multiple output (MIMO) communication systems, said antenna arrangement comprising:

a first antenna;

a second antenna; and a third antenna positioned substantially between the first and the second antennas;

wherein the antennas are shaped such that their combined radiation pattern exhibits a substantially omni-directional radiation pattern, and the antenna arrangement comprises a plurality of layers, the plurality of layers including first, second and third layers arranged in aligned parallel orientation.

19. The antenna arrangement of claim 18, wherein a first insulating layer is disposed between the first and second layers and a second insulating layer is disposed between the second and third layers.

20. The antenna arrangement of claim 18, wherein the first, second and third antennas are metal layers.

* * * * *